US006800146B2

(12) United States Patent
Matsumoto et al.

(10) Patent No.: US 6,800,146 B2
(45) Date of Patent: Oct. 5, 2004

(54) MAGNETIC CIRCUIT MEMBER

(75) Inventors: Akikazu Matsumoto, Toyota (JP); Wataru Yagi, Nagoya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 81 days.

(21) Appl. No.: 10/100,003

(22) Filed: Mar. 19, 2002

(65) Prior Publication Data

US 2003/0005978 A1 Jan. 9, 2003

(30) Foreign Application Priority Data

Mar. 19, 2001 (JP) ..... 2001-079094

(51) Int. Cl.[7] ..... H01F 1/14

(52) U.S. Cl. ..... 148/307; 148/306; 420/9; 420/13; 420/29; 420/33; 420/117; 420/129

(58) Field of Search ..... 148/306, 307, 148/320, 110, 112; 420/9, 13, 117, 129, 29, 33

(56) References Cited

U.S. PATENT DOCUMENTS 3,920,451 A * 11/1975 Gierek et al. ..... 420/15
4,990,194 A * 2/1991 Obata et al. ..... 148/543
5,067,993 A * 11/1991 Wakita et al. ..... 148/311
2003/0024608 A1 * 2/2003 Cooper ..... 148/321

FOREIGN PATENT DOCUMENTS

| | | | |
|---|---|---|---|
| JP | 56-9354 | * | 1/1981 |
| JP | 57-89423 | * | 6/1982 |
| JP | 57-164959 | * | 10/1982 |
| JP | 58-67844 | * | 4/1983 |
| JP | 10-169823 | | 6/1998 |
| JP | 10-171539 | | 6/1998 |

* cited by examiner

*Primary Examiner*—John P. Sheehan
(74) *Attorney, Agent, or Firm*—Oblon, Spivak, McClelland, Maier & Neustadt, P.C.

(57) ABSTRACT

A magnetic circuit member contains a matrix portion including iron and silicon; and graphite particles in the matrix. Each of the graphite particles has either a spherical shape or a compact vermicular shape. The inclusion of graphite particles having a relatively low conductivity in the matrix portion having a good magnetic property prevents eddy currents from forming in the magnetic circuit member in an alternating magnetic field, thus preserving the original magnetic property found in the absence of the alternating magnetic field. Each of the graphite particles has a spherical or compact vermicular shape that does not intercept magnetic flux passing through the material forming the magnetic circuit member. The graphite contained in the material improves liquidity of the melted material in casting, thus the magnetic circuit member can be manufactured by casting.

9 Claims, 4 Drawing Sheets

100 μm

MAGNETIC CIRCUIT MEMBER

BACKGROUND OF THE INVENTION

1. Field of the Invention

This invention relates to a magnetic circuit member. More particularly, this invention relates to a magnetic circuit member that can be employed in a magnetic circuit in a solenoid valve or in a magnetic sensor including a core, a yoke and a housing.

2. Discussion of the Background

A material for forming a magnetic member in a solenoid employed in a pressure control valve is disclosed in Japanese Patent Application Publication Toku-Kai-Hei 10 (1998)-171539, published Dec. 12, 1998. In this conventional pressure control valve, pure iron with soft magnetism or low-carbon steel such as S10C is used to form a magnetic circuit. When electric current is fed to the solenoid coil and the solenoid coil is magnetically excited, magnetic flux is generated by the solenoid coil. The magnetic flux passes through a yoke portion and a plunger portion of the pressure control valve to move and displace the plunger portion. A sleeve connected to the plunger moves with the plunger to control oil pressure.

Recently, it has become desirable for the solenoid used for controlling the oil amount or the oil pressure in a pressure control valve to have a good response to an externally applied magnetic field and to exhibit linearity in magnetic attracting force in order to improve the controllability of the solenoid. If the coil of the solenoid has a good response, the solenoid can be always slightly movable, balancing forces applied to the plunger in order to prevent the plunger portion from being locked.

If the magnetic attracting forces generated by the solenoid coil can be increased linearly relative to an electric voltage applied to the solenoid coil, a control circuit for controlling the solenoid coil can be simplified. As a result the control circuit can be manufactured at low cost. However, when pure iron or low-carbon steel is used to form the magnetic circuit member of the solenoid, the desired response and linearity of magnetic attracting force cannot be achieved.

Conventional magnetic members made from pure iron or low-carbon steel are manufactured by cutting and machining bar-shaped samples of pure iron or low-carbon steel. However, cutting and machining are expensive processes. Furthermore, if a magnetic member needs to be formed into a complex shape, then a large amount of material tends to be wasted in the machining process. This further increases the manufacturing cost of a magnetic member of a solenoid.

An inexpensively produced magnetic circuit member for a solenoid is needed that has a good response to an external magnetic field and linearity in magnetic attracting force relative to electric voltage applied to the coil of the solenoid.

SUMMARY OF THE INVENTION

The present invention provides a magnetic circuit member that can be manufactured at low cost, that has a good magnetic response, and that has good magnetic linearity to a magnetic field applied from the outside of the magnetic circuit member.

Research by the present inventors has demonstrated that the deterioration of the magnetic properties of conventional magnetic circuit members (yoke portion, plunger portion and so on) is generated by an alternating magnetic field.

Typically, the solenoid coil and the like are applied with an alternating electric current at 100 Hz to 300 Hz, and then the plunger portion is slightly vibrated. But, in the conventional art, when an alternating electric current flows in a magnetic circuit member made of pure iron or low-carbon steel, eddy currents flow in the magnetic circuit member. The permeability of the magnetic circuit member when eddy currents flow is smaller the permeability of the magnetic circuit member when a direct current flows in the magnetic circuit member, leading to a decrease in magnetic flux density. It becomes difficult to pass magnetic flux through the yoke portion and the plunger portion. Accordingly, if the magnetic flux is concentrated in an end portion of the yoke portion when the plunger portion is departed from the yoke portion, then early saturation of the magnetic flux is generated in the end portion of the yoke portion, the flow of the magnetic flux is reduced, and then the response and the linearity are spoiled. The present inventors arrived at the conclusion that improving the permeability of the magnetic flux passing through the material accelerates the improvements in the magnetic property.

According to a first aspect of the present invention, a magnetic circuit member comprises a ferrite matrix including iron and silicon; and graphite particles in the ferrite matrix, where each of the graphite particles has either a spherical shape or a compact vermicular shape. The inclusion of the graphite, which has a relatively large electrical resistance, in the matrix, which has good magnetic properties, prevents eddy currents from forming in the magnetic circuit member and preserves the good magnetic properties of the magnetic circuit member. As a result, magnetic properties of the magnetic circuit member in an alternating magnetic field can be improved. The graphite particles have either a spherical or a compact vermicular (CV) shape so as to not intercept the magnetic flux passing through the magnetic circuit member. Including the graphite in the magnetic circuit member improves liquidity of the material during casting and facilitates casting.

According to a second aspect of the present invention, to improve magnetic properties in the magnetic circuit member the mass of carbon is preferably less than or equal to 3% relative to the entire mass of the magnetic circuit member, and the mass of silicon is preferably more than or equal to 3% relative to the entire mass of the magnetic circuit member. If the mass of the carbon is larger than 3%, then the magnetic flux density of the magnetic circuit member and the magnetic attracting force are too small and the magnetic circuit member cannot achieve a desired performance.

According to a third aspect of the present invention, the matrix portion preferably includes an iron-silicon compound.

According to a fourth aspect of the present invention, the mass of carbon in the matrix is 0.03% or less relative to the mass of the matrix. If the mass of carbon is larger than 0.03%, then the magnetic property (especially soft magnetism) is substantially spoiled. In particular, the maximum permeability $\mu_m$ tends to be smaller, and the coercive force tends to be larger.

According to a fifth aspect of the present invention, an average particle diameter of the graphite is preferably less than or equal to 50 $\mu$m in order to prevent the graphite from intercepting the magnetic flux passing through the magnetic circuit member.

BRIEF DESCRIPTION OF THE DRAWINGS

The foregoing and additional features and characteristics of the present invention will become more apparent from the following detailed description considered with reference to accompanying drawings in which like reference numerals designate like elements and wherein.

DETAILED DESCRIPTION OF PREFERRED EMBODIMENTS

Figure 1:
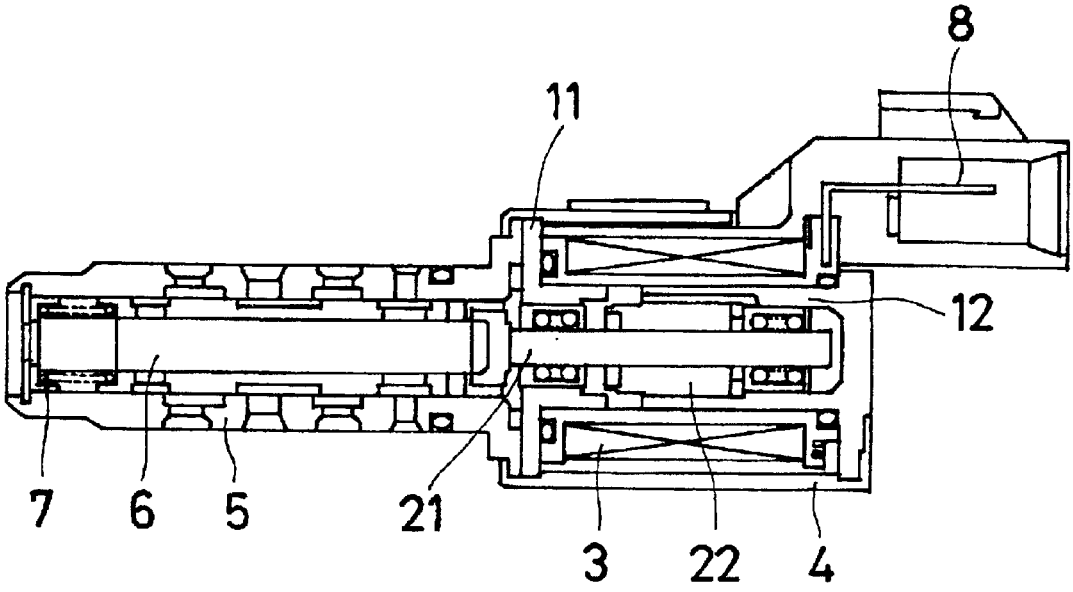
FIG. 1 shows a schematic structural cross-sectional view of a fluid valve implemented according to the embodiments.

Hereinafter, embodiments of the present invention will be described based on FIGS. 1 to 4. The magnetic circuit member of the present invention can be applied to a solenoid valve, a motor and the like as the electric motor employing an alternating magnetic field taken in a broad sense.

The magnetic circuit member contains a matrix portion and graphite dispersed in the matrix. The matrix portion forms the majority of the magnetic circuit member. The matrix portion is an iron-based alloy of iron-ferrite including silicon.

The matrix portion contains spherical and/or compact vermicular shaped graphite. The magnetic member can be manufactured by cutting or machining from a bar-shaped raw material as conventionally manufactured, but can be manufactured by casting because of its high carbon content.

The matrix portion itself is superior in magnetic properties. In the matrix portion, the mass of the silicon is preferably 3% or more relative to the total mass of the magnetic circuit member. If the mass of the silicon is 3% or more, then the matrix portion easily forms a ferrite microstructure, to improve its magnetic property. Moreover, the mass of the silicon is preferably no less than 3.8%, and the silicon is preferably contained in the matrix portion as an iron-silicon compound ($Fe_3Si$). The matrix preferably contains no more the 0.03 mass % of carbon in order to achieve satisfactory magnetic properties in the matrix portion. For magnetic property of the matrix portion, heating the magnetic circuit member in between 680° C. and 950° C. converts $Fe_3Si$ into graphite (and converts the microstructure of the matrix portion into the ferrite microstructure), therefore the amount of the carbon in the matrix portion is reduced.

The graphite particles contained in the matrix portion have "spherical or compact vermicular" shapes. This means that the graphite is formed into a shape so as not to intercept the magnetic flux passing through the magnetic circuit member. In particular, circularity of the graphite is preferable to be no less than 50%. In addition, the average size of the graphite is preferably no more than 50 $\mu$m. Methods for forming graphite into spherical or compact vermicular shapes includes adding the spherical material containing Mg, Ce and the like into melted iron-material including a predetermined amount of carbon, and heating the squamiform graphite precipitated in the matrix portion to form a spherical shape after forming a magnetic circuit member. The graphite is preferably no more than 3%, and more preferably less than 2%, relative to the total mass of the entire magnetic circuit member. Because of the low specific gravity of the graphite, 3 weight % of the graphite corresponds to 10 volume % of graphite relative to the total volume of the entire magnetic circuit member. The magnetic property in a static magnetic field of a magnetic circuit member containing 3 weight % carbon is calculated to be about 90% of the static field magnetic property that would be achieved with a magnetic circuit member made entirely of the matrix portion and without the carbon.

EXAMPLE 1

Method of Manufacturing Magnetic Circuit Member

Iron containing 2% of graphitic carbon and 3.8% of Si relative to the total mass thereof is melted in a high-frequency heating furnace. Magnesium-alloy (manufactured by Toyo Denka Kogyo), as a sphericalizing material for forming the graphite into a spherical shape having a particle diameter 20 mm and including 4.8% of Mg, 46% of Si, and 2.4% of Ca by mass, is prepared in an amount of 1.6% relative to the total mass of the iron-material in a melting pot. After incorporating a cover material on the magnesium alloy in the melting pot for controlling the reaction rate, the melted iron-material is gradually poured into the magnesium-alloy in the melting pot, then the graphite included in the iron-material is formed into the spherical shape. The resulting iron-material with the sphericalizing material is cast to form predetermined shapes of a yoke and a plunger in sand molds according to their predetermined shapes. After being removed from the sand molds, the molded material is cut or machined to be formed into the desired shapes of the yoke and the plunger. Then the resulting yoke and the plunger are provided with ferrite microstructures by heating and assembled into a fluid valve.

The fluid valve is shown in FIG. 1. The fluid valve includes a solenoid coil 3, a connecter 8 electrically connected with the solenoid coil 3, a front yoke 11, a rear yoke 12 and a plunger portion 22 all of which form magnetic circuit members. The fluid valve further includes a shaft 21 fixed with the plunger portion 22 at one end (right end in FIG. 1) side thereof by stacking, a sleeve 5 disposed at the other end (left end in FIG. 1) side of the shaft 21, a valve body 6 disposed adjacent the other end of the shaft 21 and supported slidably movable in the sleeve 5, and a spring portion 7 disposed at the other end (left end in FIG. 1) portion of the sleeve 5 for always urging the valve body 6 to a direction for opening the fluid valve.

EXAMPLES 2 TO 11 AND REFERENCE SAMPLES 1 TO 3

Iron including the amounts of carbon and silicon shown in Table 1 are formed into magnetic circuit members as described in the example 1. The magnetic circuit members are assembled to be the fluid valves of the examples 2 to 11 and the reference samples 1 to 3.

Microstructure

Figure 2:
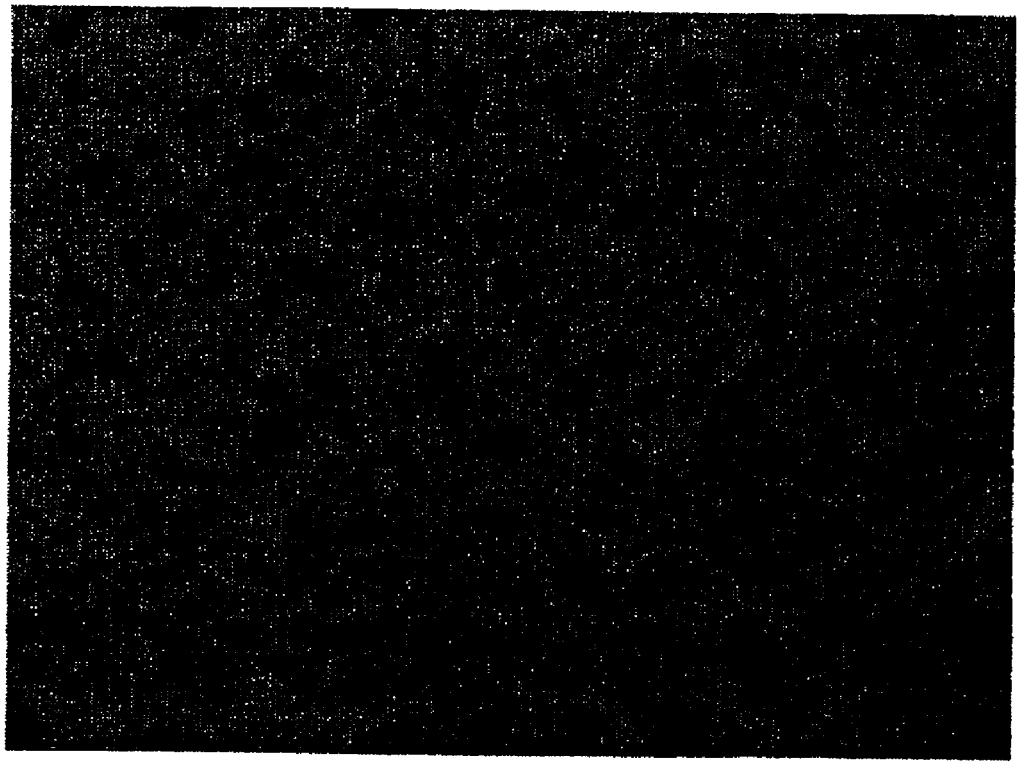
FIG. 2 shows a photograph of the microstructure of the magnetic circuit member implemented according to example 11.

FIG. 2 is a picture of the microstructure of the iron-material of the magnetic circuit member of example 11. As shown in FIG. 2, spherical graphite grains (black portion in FIG. 2) are separately located in the matrix portion containing the ferrite (white portion in FIG. 2).

Although pictures of the magnetic circuit members of examples 1 to 10 are not shown, the present inventors have confirmed that the spherical graphite grains are separately located and dispersed in the matrix portion as shown in FIG. 2 for example 11. According to the reference samples 1 and 3, the iron-materials include matrix portions as in example 11, but the spherical graphite grains are not separately located in the matrix portions as in example 11. According to the reference sample 2, the spherical graphite grains are separately located in the matrix portion as in example 11 (and examples 1–10), but the matrix portion has been confirmed to be different from those of the examples because the matrix portion in the reference sample 2 is made of the pearlite microstructure.

Evaluation Test

Magnetic Attracting Force Test

In a magnet attracting force test, according to the examples and the reference samples, a relation between the distance moved by the plunger 21 and a magnetic attracting force generated by the solenoid coil 3 was measured under different values of an electric current supplied to the solenoid coil 3.

The magnetic attracting force of the solenoid coil 3 is measured as follows. After fixing the electric current value at a predetermined value, the plunger 21 is gradually urged with a predetermined load, then a stroke amount corresponding to the load value applied to the plunger 21 are measured. In addition, the spring portion 7 is detached from the fluid valve for convenience of the measurement (for setting a load cell). The magnetic attracting forces are measured, as the electric current supplied to the solenoid coil 3 is changed from 0.4 A to 1.0 A by 0.1 A under PWM control (300 Hz).

A load of the spring portion 7 attached at the left end of the sleeve 5 corresponding to a stroke amount is considered to be defined by the following formula:

$$(\text{spring load } (N)) = 7.8 \times (\text{Stroke amount } (mm)).$$

Figure 3:
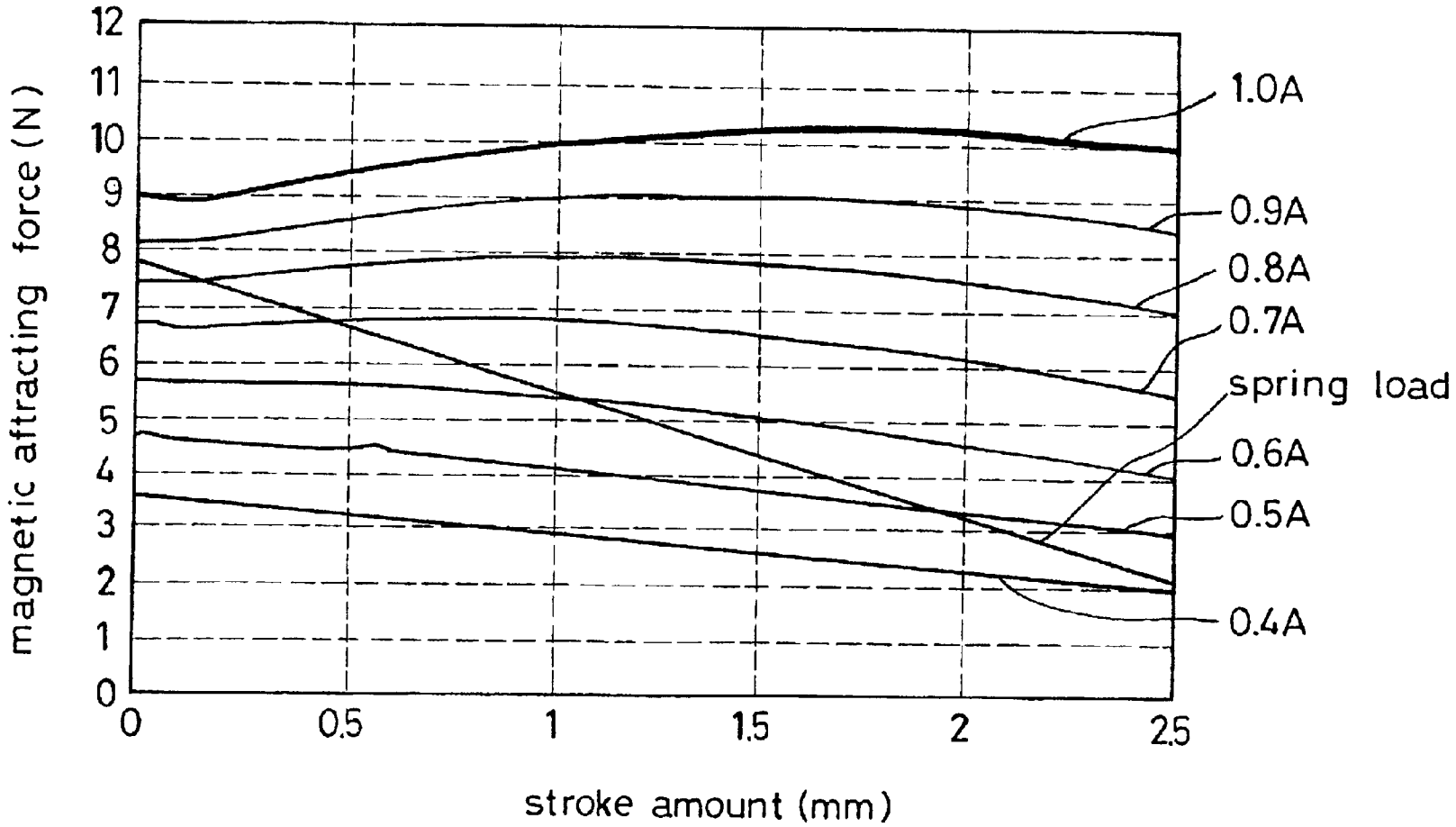
FIG. 3 shows the relation between a stroke amount and a magnetic attracting force at each electric current value in the reference sample 1.

The load of the spring portion 7 is indicated as a straight line in the graph in FIG. 3.

The magnetic attracting force generated at each of the electric current value between 0.4 A and 1.0 A is also indicated as curved lines in the graph in FIG. 3. Therefore, intersecting points of the straight line and each cured line are obtained. The stroke amount is defined as zero at the left end of the movable range of the plunger potion 21. The stroke amount corresponding to the right side based on the left end of the movable range is regarded as the positive value.

The intersecting point of the straight line and the curved line at 0.9A is regarded as a point 1, an intersecting point of the straight line and the curved line at 0.8A is regarded as a point 2, an intersecting point of the straight line and the curved line at 0.7A is regarded as a point 3, an intersecting point of the straight line and the curved line at 0.6A is regarded as a point 4, an intersecting point of the straight line and the curved line at 0.5A is regarded as a point 5. The ratio of the difference between the stroke amounts at the intersecting points, A (the point 2–the point 1): B (the point 3–the point 2): C (the point 4–the point 3): D (the point 5–the point 4) is calculated. Each magnetic attracting force according to the fluid valve of the examples and the reference samples is measured when each of the stroke amount was determined to be 2.5 mm and each of the electric current is determined to be 1.0 A. The content of iron-silicon compounds is measured by X-ray crystallographic analysis. The results of the measurements are shown in Table 1. To indicate evaluation of the magnetic properties in the Table 1, symbol "+" means superiority of this evaluation, symbol "–" means inferiority of this evaluation. Practical relations between the stroke amounts and the magnetic attracting forces corresponding to each of the electric current value are found and then a part of the relations are shown in FIG. 3 (according to the reference sample 1) and FIG. 4 (the example 11).

The magnetic property of each of the materials employed in the fluid valves of the examples and the reference samples is measured under 540 A/m of a magnetic field alternating at 300 Hz.

The results are shown in Table 2.

TABLE 1

| | Main components of magnetic circuit member | | | Magnetic attracting force evaluation | | | |
|---|---|---|---|---|---|---|---|
| | C (%) | Si (%) | Carbon content of matrix portion (%) | Magnetic attracting force at 1A (N) | Ratio of difference between stroke amounts A:B:C:D | Iron-silicon compounds | Total evaluation |
| example 1 | 3.7 | 2.7 | 0.12 | 7.5 | 1:2.1:2.3:3 | No | + |
| example 2 | 3.5 | 2.9 | 0.13 | 7.6 | 1:2:2.3:2.9 | No | + |
| example 3 | 3.6 | 2.3 | 0.13 | 7.2 | 1:2:2.4:2.8 | No | + |
| example 4 | 2.4 | 3.0 | 0.12 | 7.8 | 1:1.5:1.8:2.1 | No | + |
| example 5 | 3.0 | 2.4 | 0.13 | 7.4 | 1:1.7:2:2.2 | No | + |
| example 6 | 2.7 | 2.1 | 0.07 | 7.2 | 1:1.6:1.9:2.2 | No | + |
| example 7 | 3.0 | 3.0 | 0.02 | 8.0 | 1:1.5:1.7:2.0 | Yes | ++ |
| example 8 | 2.8 | 3.8 | 0.02 | 8.4 | 1:1.3:1.6:1.9 | Yes | ++ |
| example 9 | 2.9 | 3.8 | 0.03 | 8.5 | 1:1.4:1.6:1.9 | Yes | ++ |
| example 10 | 2.0 | 3.9 | 0.02 | 9.1 | 1:1.2:1.2:1.3 | Yes | +++ |
| example 11 | 2.0 | 3.8 | 0.02 | 9.0 | 1:1.3:1.2:1.2 | Yes | +++ |
| reference sample 1 | 0.1 | 0.05 | 0.02 | 9.2 | 1:2.2:4.3:6.7 | No | – |
| reference sample 2 | 3.5 | 3.5 | 0.13 | 7.0 | 1:1.4:1.7:2.0 | No | – |
| reference sample 3 | 0.01 | 0.01 | 0.02 | 9.4 | 1:2.3:4.6:6.8 | No | – |

TABLE 2

| | Magnetic flux density (mT) | Magnetic permeability: $\mu$ | Hc coercive forces (A/m) |
|---|---|---|---|
| Magnetic circuit member of example 1 | 429 | 976 | 375 |
| Magnetic circuit member of example 2 | 410 | 960 | 373 |
| Magnetic circuit member of example 3 | 415 | 955 | 370 |

TABLE 2-continued

| | Magnetic flux density (mT) | Magnetic permeability: $\mu$ | Hc coercive forces (A/m) |
|---|---|---|---|
| Magnetic circuit member of example 4 | 550 | 1130 | 369 |
| Magnetic circuit member of example 5 | 440 | 1005 | 371 |
| Magnetic circuit member of example 6 | 515 | 1090 | 371 |
| Magnetic circuit member of example 7 | 570 | 1180 | 370 |
| Magnetic circuit member of example 8 | 579 | 1189 | 369 |
| Magnetic circuit member of example 9 | 575 | 1180 | 369 |
| Magnetic circuit member of example 10 | 596 | 1352 | 359 |
| Magnetic circuit member of example 11 | 589 | 1345 | 357 |
| Magnetic circuit member of reference sample 1 | 332 | 797 | 419 |
| Magnetic circuit member of reference sample 2 | 310 | 841 | 380 |
| Magnetic circuit member of reference sample 3 | 354 | 790 | 449 |

As shown in Table 1, the fluid valves of examples 1 to 11 are assured to be superior to the fluid valves of reference samples 1 to 3. The ratios of difference between the stroke amounts at the intersecting points in the reference samples 1 and 3 are 6.7 and 6.8 as the maximum, respectively. To the contrary, the ratios of difference between the stroke amounts at the intersecting points in the examples 1 to 11 are 3.0 (in the example 1) as the maximum ratio, thus the fluid valves of the examples 1 to 11 are excellent in viewpoint of linearity of the magnetic attracting force depending on the electric current value. In particular, the ratios of difference between stroke amounts of the fluid valves in the examples 7 to 11 are no less than 2.0, thus the linearity in each of the examples 7 and 11 is found to be substantially excellent. It is conceivable that the magnetic circuit members in the examples contribute to the improvement in the magnetic property thereof in the alternate magnetic field at high frequency by including the graphite in the magnetic circuit member. It can be also considered based in that the fluid valve in the reference sample 2 (including the graphite) is excellent in the linearity. (The difference between the stroke amounts at the intersecting points in the reference sample 2 is 2.0 as the maximum.) Since the iron-material forming the magnetic circuit member in the reference sample 2 is cast iron, the graphite is precipitated in the cast iron. The graphite in the cast iron is as effective as the graphite in the examples. In addition, as the ratio of difference between the stroke amounts at the intersecting points is small, the linearity of the stroke amount (spring load) to the electric current value is considered to be excellent.

The magnetic attracting force of the fluid valve electrically fed with 1.0 A of the electric current in the reference sample 2 is found to be 7.0 N. Each of the magnetic attracting force in the examples is superior to that in the reference sample 2 (7.2 N in the example 6 as the minimum). In particular, each of the magnetic attracting force in the examples 7 to 11 is found to be larger than or equal to 8.0 N, thus each of the magnetic attracting force in the examples 7 to 11 is assured to be substantially excellent. The excellent magnetic attracting force in the examples results because the magnetic property of ferrite forming the matrix portion in the examples is superior to that of pearlite forming the matrix portion in the reference sample 2. It can be expected that the magnetic attracting forces of the fluid valves in the reference samples 1 and 3 (having a ferrite microstructure) are 9.2 N and 9.4 N as satisfactory values, respectively, when 1.0 A of electric current is supplied to the fluid valves.

As described above, the fluid valves in the examples are assured to be superior to the fluid valve in the reference samples. Especially, the fluid valves in the examples 7 to 10 are excellent due to the following three conditions. The three conditions are that the carbon content is preferably less than or equal to 3.0%, that the silicon content is preferably more than or equal to 3.0%, and that silicon-iron compounds are preferably to be included in the matrix portion.

Figure 4:
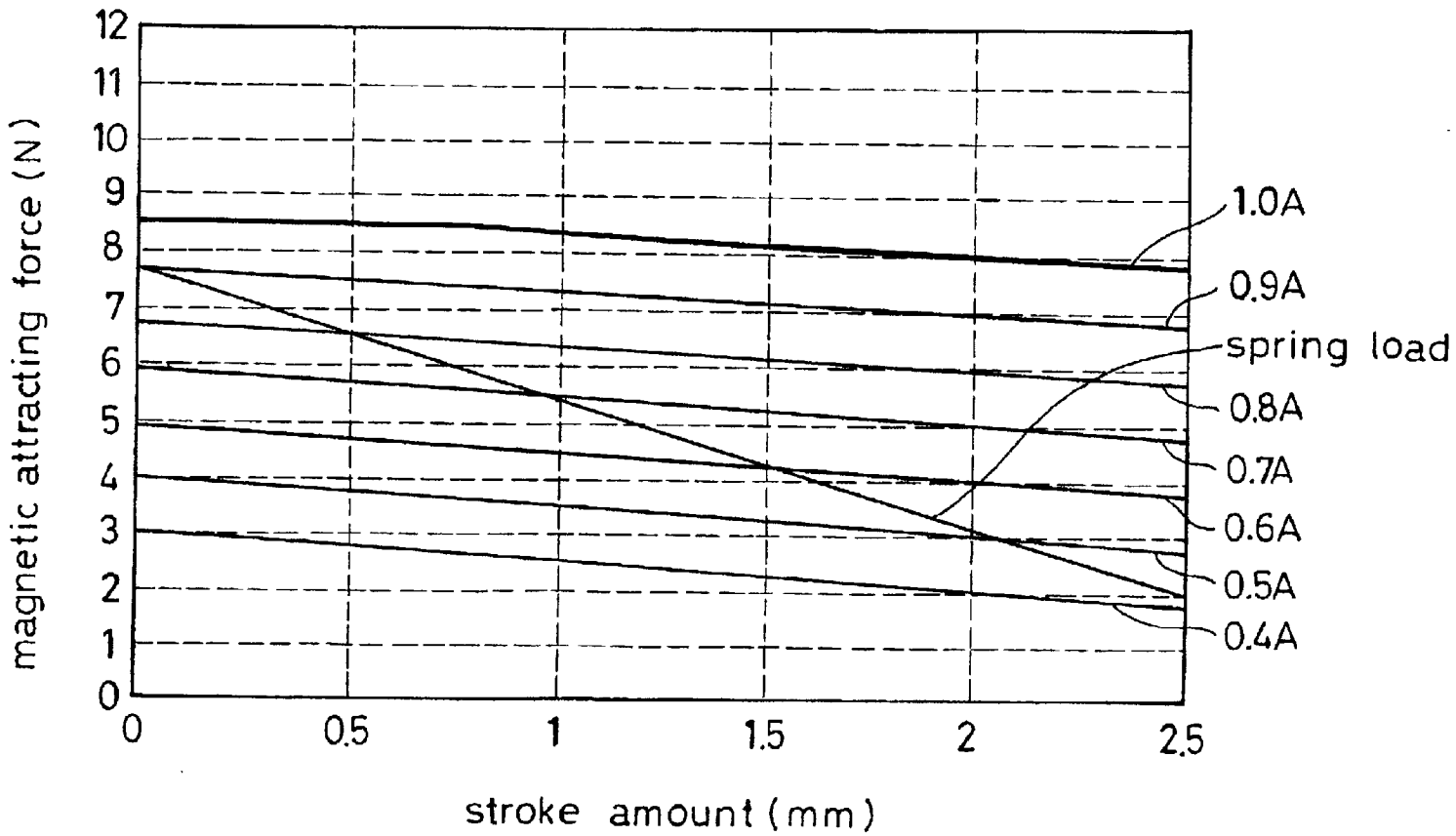
FIG. 4 shows the relation between a stroke amount and a magnetic attracting force at each electric current value in example 11.

As can be seen in only detail portions in FIGS. 3 and 4, the fluid valve in the example 11 is assured to be activated substantially following the electric current alternating at 300 Hz compared with the fluid valve in the reference sample 1.

As these above results are shown in Table 2, the materials employed in the embodiments are superior to those employed in the reference samples in viewpoint of magnetic flux density and permeability. In addition, each coercive force of the material in the examples is small, then the material in the examples can be expected to be excellent as soft magnetism material.

Permeability Dependency on Alternate Magnetic Field Frequency

Permeability of each of the magnetic circuit member manufactured in the examples 7 and 10 and the reference samples 1 to 3 is measured under different frequencies of the alternate magnetic field as shown in Table 3. The results of the above measurement are shown in Table 3.

TABLE 3

| Frequency (Hz) | Reference sample 1 | Reference sample 2 | Reference sample 3 | Example 7 | Example 10 |
|---|---|---|---|---|---|
| 10 | 2992 | 2958 | 3424 | 4143 | 4310 |
| 20 | 2415 | 2450 | 2824 | 3225 | 3620 |
| 50 | 1722 | 1869 | 2044 | 2431 | 2460 |
| 100 | 1319 | 1459 | 1557 | 1840 | 1917 |
| 300 | 804 | 980 | 790 | 1246 | 1327 |
| 500 | 637 | 804 | 688 | 995 | 1016 |
| 1000 | 418 | 587 | 468 | 703 | 777 |

As seen in FIG. 3, at each of the frequencies, each of the permeabilities of the examples 7 and 10 is larger than each of the permeabilities of the reference samples 1 to 3. A permeability reductions in accordance with the increase of the frequency of the alternate magnetic field in the examples 7 and 10 (17.0% and 18.0% with each of the permeability at 10 Hz being 100%) is smaller than those in the reference samples 1 and 3 (14.0% and 13.7%). The permeability reduction in the reference sample 2 is substantially small (19.0%). Therefore, the large graphite content improves the magnetic property of the material at high frequencies (at 1000 Hz and more).

As described above, the magnetic circuit member produced by the present invention is superior to conventional magnetic circuit members in viewpoint of the magnetic property in an alternate magnetic field at high frequencies. The magnetic circuit member of the present invention can be preferably employed as the magnetic circuit member used in magnetic fields alternating at high frequencies.

In addition, since the magnetic circuit member of the present invention includes graphite, the magnetic circuit member can be easily cast compared with conventional magnetic circuit members. Thus the magnetic circuit member of the present invention brings manufacturing cost reduction.

The disclosure of the priority document, Japanese Patent Application No. 2001-079094 filed Mar. 19, 2001, is incorporated by reference herein in its entirety.

Having now fully described the invention, it will be apparent to one of ordinary skill in the art that many changes and modifications can be made without departing from the spirit or scope of the invention as set forth herein.

What is claimed is:

1. A magnetic circuit member consisting of a matrix comprising ferrite having silicon in solid solution with iron;

graphite particles in the matrix;

optionally, an iron-silicon compound in the matrix; and inevitable impurities, wherein each of the graphite particles has either a spherical shape or a compact vermicular shape; and the total amount of silicon in the magnetic circuit member is 3 mass % or more.

2. The magnetic circuit member according to claim 1, wherein the total amount of carbon in the magnetic circuit member is 3 mass % or less.

3. The magnetic circuit member according to claim 1, wherein the total amount of carbon in the magnetic circuit member is 2.8 mass % or less.

4. The magnetic circuit member according to claim 1, wherein the total amount of silicon in the magnetic circuit member is 3.8 mass % or more.

5. The magnetic circuit member according to claim 1, wherein the iron-silicon compound is present in the matrix.

6. The magnetic circuit member according to claim 5, wherein the iron-silicon compound is $Fe_3Si$.

7. The magnetic circuit member according to claim 1, wherein the matrix further comprises carbon in an amount of 0.03 mass % or less relative to the matrix.

8. The magnetic circuit member according to claim 1, wherein the graphite particles have an average particle diameter of 50 $\mu$m or less.

9. A method of making a magnetic circuit member, the method comprising forming a melt containing iron, carbon and silicon;

casting the melt; and producing the magnetic circuit member of claim 1.

* * * * *